US005271542A

United States Patent [19]

Yamamoto

[11] Patent Number: 5,271,542

[45] Date of Patent: Dec. 21, 1993

[54] APPARATUS FOR CHANGEABLY SETTING WIDTH OF SHEET GUIDE PATH

[75] Inventor: Yuji Yamamoto, Wakayamashi, Japan

[73] Assignee: Eastman Kodak Company, Rochester, N.Y.

[21] Appl. No.: 907,357

[22] Filed: Jul. 1, 1992

[30] Foreign Application Priority Data

Jul. 24, 1991 [JP] Japan ..... 3-184735

[51] Int. Cl.[5] ..... B65H 23/02

[52] U.S. Cl. ..... 226/199; 226/179; 226/198; 242/71.9

[58] Field of Search ..... 226/79, 179, 190, 192, 226/198, 199; 242/71.9

[56] References Cited

U.S. PATENT DOCUMENTS

| | | | |
|---|---|---|---|
| 2,630,901 | 3/1953 | Johnson et al. | 226/79 |
| 2,979,829 | 4/1961 | Uhleen | 226/179 X |
| 3,163,343 | 12/1964 | Zernov | 226/199 |
| 3,399,816 | 9/1968 | Stalinski | 226/79 |
| 3,558,223 | 1/1971 | Hemphill | 355/23 |
| 3,602,417 | 8/1971 | Bennet | 226/199 |
| 4,037,769 | 7/1977 | Megers | 226/199 X |
| 4,358,039 | 11/1982 | Buzzell | 226/79 |
| 4,652,117 | 3/1987 | Kogane et al. | 355/72 |
| 4,750,660 | 6/1988 | Kamimura | 226/199 |
| 4,752,145 | 6/1988 | Schelshorn et al. | 226/199 X |

*Primary Examiner*—Daniel P. Stodola
*Assistant Examiner*—Paul T. Bowen
*Attorney, Agent, or Firm*—David A. Howley

[57] ABSTRACT

An apparatus for changeably setting a width of a sheet guide path for a sheet includes a pair of sheet guide members set at both sides, respectively, of the sheet guide path to face each other and to be movable in a transverse direction of the sheet guide path so as to define the width of the sheet guide path therebetween and a pair of positioning members which move one of the sheet guide members, respectively, in the transverse direction to position the corresponding sheet guide members. The positioning members are rotatable about a mutual axis extending in the transverse direction and each having a plurality of cam surfaces which are circumferentially offset from each other about the mutual axis and stepwisely offset from each other in the direction of the mutual axis, the sheet guide members being engaged with the cam surfaces of the corresponding positioning members.

6 Claims, 2 Drawing Sheets

APPARATUS FOR CHANGEABLY SETTING WIDTH OF SHEET GUIDE PATH

FIELD OF THE INVENTION

The present invention relates to an apparatus for changeably setting the width of a path for guiding a sheet in a sheet feeder.

BACKGROUND OF THE INVENTION

For example, in an automatic photographic printing operation, a continuous strip of photographic paper is intermittently fed to a printing position, and it is necessary in order to carry out proper printing to accurately feed the photographic paper along a predetermined guide path.

Photographic paper varies in width, therefore, it is necessary to change the width of the photographic paper guide path accurately so as to conform to the width of the photographic paper being used.

A typical conventional means for changeably setting the width of a sheet guide path has a shaft that crosses the guide path and a pair of sheet guide members which are mounted on the shaft at both sides, respectively, of the guide path to define the width of the guide path, the guide members being in engagement with respective threads which are provided on both end portions of the shaft in opposite directions to each other, so that the guide members move toward and away from each other on the shaft in response to the rotation of the shaft, thereby determining the respective portions of the guide members, and thus setting the width of the guide path.

The above-described conventional apparatus for changeably setting the width of the guide path suffers, however, from the following disadvantages:

It is difficult to rotate the shaft accurately, and since undesirable play, for example, backlash in the thread engagement, is likely to occur, it is difficult to position the guide members accurately by rotation of the shaft. In order to overcome these disadvantages, a sensor of high accuracy and a complicated detecting mechanism are needed.

PROBLEM TO BE SOLVED BY THE INVENTION

It is an object of the present invention to eliminate the above-described disadvantages of the prior art and provide an apparatus which is capable of changeably setting the width of the guide path accurately.

SUMMARY OF THE INVENTION

More specifically, the present invention provides an apparatus for changeably setting the width of a sheet guide path for a sheet, comprising: a pair of sheet guide members set at both sides, respectively, of the sheet guide path to face each other and to be movable in the transverse direction of the sheet guide path so as to define the width of the sheet guide path therebetween; and a pair of positioning members which move the sheet guide members, respectively, in the transverse direction to position the corresponding sheet guide members, the positioning members being rotatable about a mutual axis extending in the transverse direction and each having a plurality of cam surfaces which are circumferentially offset from each other about the mutual axis and stepwisely offset from each other in the direction of the mutual axis, the sheet guide members being engaged with the cam surfaces of the corresponding positioning members, thereby being position in the transverse direction.

BRIEF DESCRIPTION OF THE DRAWINGS

The present invention will be described below in detail by way of one embodiment and with reference to the accompanying drawings.

DETAILED DESCRIPTION OF THE INVENTION

Figure 1:
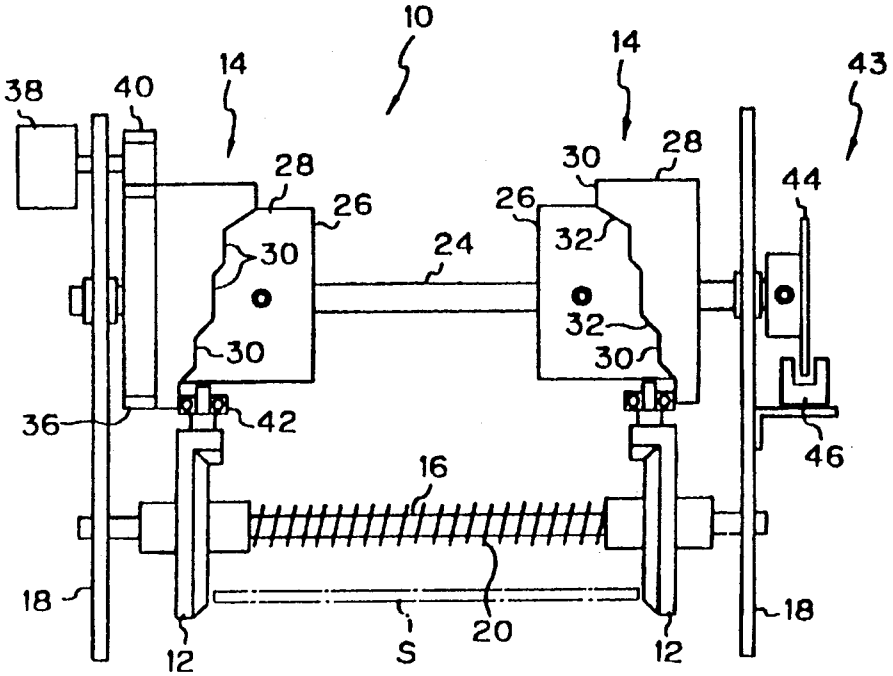
FIG. 1 is a front view showing the essential part of the apparatus for changeably setting the width of a sheet guide path according to the present invention.

Referring to FIG. 1, an apparatus 10 for changeably setting the width of a sheet guide path comprises a pair of sheet guide members 12 which are set adjacent to the longitudinally extending edges, respectively, of a sheet S to be guided to define the width of a guide path for the sheet S, and a pair of positioning members 14 which move the respective sheet guide members 12 in the transverse direction of the sheet S (or the sheet guide path) to position them.

The sheet guide members 12 are slidably mounted on a second shaft 16 extending in the transverse direction of the sheet guide path. The second shaft 16 is secured to side plates 18 of the apparatus. In addition, a compression spring 20 is set between the two sheet guide members 12 to bias them away from each other.

The positioning members 14 are fixedly mounted on a first shaft 24 that is rotatably attached to the side plates in parallel to the shaft 16. Each positioning member 14 has an inner cylindrical member 26 secured to the first shaft 24 and an outer cylindrical member 28 that is secured to the outer side of the cylindrical member 26. The opposing surfaces of the two outer cylindrical members 28 each have a plurality of flat cam surfaces 30 which are circumferentially offset from each other and stepwisely offset in the direction of the axis, each pair of adjacent cam surfaces 30 being connected by a slant surface 32. In addition, the left-hand (as viewed in FIG. 1) outer cylindrical member 28 has a gear 36 formed at the left-hand end thereof, the gear 36 being meshed with a gear 40 that is rotatably set on the left-hand side plate and that is driven to rotate by a motor 38, so that the two positioning members 14 are rotated by the motor 38.

Each sheet guide member 12 has a rotating roller 42, which is pressed against one of the cam surfaces 30 by the force from the compression spring 20, so that, when the corresponding positioning member 14 is rotated, the roller rotates to maintain the contact with the cam surfaces 30.

In the illustrated embodiment, the cam surfaces 30 of the two positioning members 14 are symmetric with respect to the longitudinal axis of the apparatus, so that, when the positioning members 14 are rotated to change the cam surface 30 engaged with each sheet guide member 12 to an adjacent cam surface 30, the two sheet guide members 12 are moved toward or away from each other through the same distance of the second shaft 16.

Figure 2:
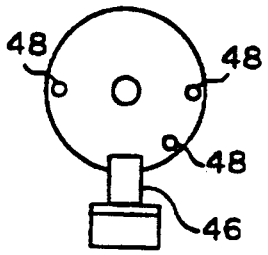
FIG. 2 is a side view of a guide path width sensing means employed in the apparatus shown in FIG. 1.
Figure 3:
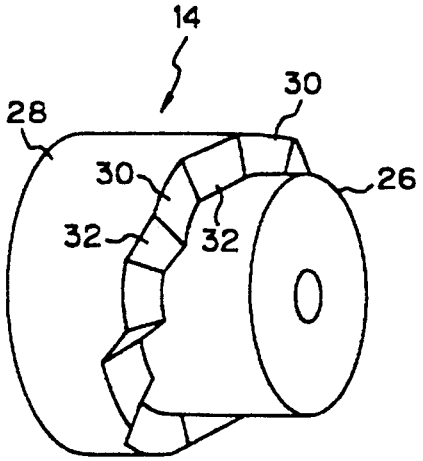
FIG. 3 is a perspective view of a sheet guide member positioning member employed in the apparatus shown in FIG. 1.

The illustrated embodiment is further provided with a means 43 for detecting the width of the sheet guide path defined between the sheet guide members 12 by detecting the position of rotation of the shaft 24. More specifically, the detecting means 43 comprises a rotary disc 44 attached to the right-hand end of the shaft 24 and a sensor 46 secured to the right-hand side plate 18. The disc 44 is provided with a plurality of holes 48 which are circumferentially spaced apart from each other to correspond to the respective positions of the cam surfaces 30 formed on the outer cylindrical member 28, as shown in FIG. 2, so that the cam surface 30 that is in engagement with the roller 42 of the sheet guide member 12 is detected by sensing the corresponding hole 48 in the disc 44 with the sensor 46, thereby enabling detection of the width of the sheet guide path defined between the two sheet guide members 12.

As has been described above, the apparatus according to the present invention is arranged such that the axial positions of the sheet guide members 12 that define the width of the sheet guide path are determined by use of a plurality of pairs of cam surfaces 30 which face each other at a predetermined distance in the widthwise direction. Accordingly, by selecting a desired pair of cam surfaces 30 which are to be engaged with the sheet guide members 12, the width of the sheet guide path defined therebetween is surely and accurately set, so that it is possible to eliminate the disadvantages in the above-described prior art apparatus in which the respective positions of the sheet guide members are set by use of thread engagement.

I claim:

1. An apparatus for changeably setting a width of a sheet guide path for a sheet, comprising:

a pair of sheet guide members set at both sides, respectively, of said sheet guide path to face each other and to be movable in a transverse direction of said sheet guide path so as to define the width of said guide path therebetween; and a pair of positioning members being rotatably about a mutual axis extending in said transverse direction and each having a plurality of cam surfaces which are circumferentially offset from each other about said mutual axis and stepwisely offset from each other in the direction of said mutual axis, said sheet guide members being engaged with said cam surfaces of said corresponding positioning members, rotation of each positioning member causing movement of its associated sheet guide member in said transverse direction, relative to said pair of positioning members, to position the corresponding sheet guide members in said transverse direction.

2. The apparatus of claim 1, wherein said positioning members are fixedly mounted on a first shaft extending in said transverse direction so that said cam surfaces which are to be engaged with said sheet guide members can be selected by rotating said shaft.

3. The apparatus of claim 2, further comprising means for detecting the width of said sheet guide path defined by said sheet guide members by detecting the position of rotation of said first shaft.

4. The apparatus of claim 3, wherein said sheet guide members are slidably set on a second shaft extending in said transverse direction.

5. The apparatus of claim 4, wherein said cam surfaces formed on each positioning member face the other positioning member, said sheet guide members being biased away from each other by a compression spring set therebetween, thereby being engaged with the corresponding cam surfaces.

6. The apparatus of claim 5, wherein each pair of adjacent cam surfaces formed on each positioning member are connected by a slant surface.

* * * * *